US008573767B2

(12) United States Patent
Edlitz et al.

(10) Patent No.: US 8,573,767 B2
(45) Date of Patent: Nov. 5, 2013

(54) SEPARATION OF ELECTROMAGNETIC RADIATION OF ELECTROMAGNETIC SPECTRUM TO CURE INK

(75) Inventors: Yochai Edlitz, Netanya (IL); Gilhad Ben-Bassat, Kfar Yona (IL)

(73) Assignee: Hewlett-Packard Industrial Printing, Ltd, Netanya (IL)

( * ) Notice: Subject to any disclaimer, the term of this patent is extended or adjusted under 35 U.S.C. 154(b) by 141 days.

(21) Appl. No.: 13/358,793

(22) Filed: Jan. 26, 2012

(65) Prior Publication Data

US 2013/0194365 A1 Aug. 1, 2013

(51) Int. Cl.
*B41J 2/01* (2006.01)

(52) U.S. Cl.
USPC ..... 347/102

(58) Field of Classification Search
USPC ..... 347/102
See application file for complete search history.

(56) References Cited

U.S. PATENT DOCUMENTS 6,739,716 B2 5/2004 Richards
7,837,319 B2 11/2010 Rodin et al.

*Primary Examiner* — Julian Huffman
*Assistant Examiner* — Sharon A Polk

(57) ABSTRACT

An image forming apparatus includes an ink applicator unit to selectively apply ultraviolet (UV) curable ink on a media, a media support unit to support the media to receive the UV curable ink, and a UV radiation curing device to cure the UV curable ink on the media. The UV radiation curing device includes a UV radiation source module to emit an electromagnetic spectrum and a dispersion member. The dispersion member may separate ultraviolet electromagnetic radiation subtype C (UVC radiation) from at least one of ultraviolet electromagnetic radiation subtype A (UVA radiation) in the electromagnetic spectrum and ultraviolet electromagnetic radiation subtype B (UVB radiation), apply the UVC radiation to the UV curable ink on the media, and subsequently apply the at least one of the UVA radiation and the UVB radiation after the UVC radiation is applied to the UV curable ink on the media.

20 Claims, 5 Drawing Sheets

SEPARATION OF ELECTROMAGNETIC RADIATION OF ELECTROMAGNETIC SPECTRUM TO CURE INK

BACKGROUND

Image forming apparatuses may form images on media. The images may be formed on the media by ultraviolet (UV) curable ink applied by an ink applicator unit. A radiation source may emit radiation to the UV curable ink on the media. The UV curable ink may be cured by the radiation applied thereto.

BRIEF DESCRIPTION OF THE DRAWINGS

Non-limiting examples of the present disclosure are described in the following description, read with reference to the figures attached hereto and do not limit the scope of the claims. In the figures, identical and similar structures, elements or parts thereof that appear in more than one figure are generally labeled with the same or similar references in the figures in which they appear. Dimensions of components, layers, substrates and features illustrated in the figures are chosen primarily for convenience and clarity of presentation and are not necessarily to scale. Referring to the attached figures:

DETAILED DESCRIPTION

Image forming apparatuses may form images on media. The images may be formed on the media with ultraviolet (UV) curable ink applied by an ink applicator unit. A radiation source may emit radiation to the UV curable ink on the media. The UV curable ink may be cured by the radiation applied thereto. However, during the curing process, oxygen from the atmosphere surrounding the ink may penetrate the UV curable ink and may increase a level of radiation to sufficiently cure the UV curable ink. Further, the radiation applied to the UV curable ink on the media may include infrared radiation that may adversely impact the media.

In examples, an image forming apparatus includes, among other things, a UV radiation source module and a dispersion member. The UV radiation source module may emit an electromagnetic spectrum. The dispersion member may separate ultraviolet electromagnetic radiation subtype C (U VC radiation) from at least one of ultraviolet electromagnetic radiation subtype A (UVA radiation) and ultraviolet electromagnetic radiation subtype B (UVB radiation) in the electromagnetic spectrum. The dispersion member may also apply the UVC radiation to the UV curable ink on the media, and subsequently apply the at least one of the UVA radiation and the UVB radiation after the UVC radiation is applied to the UV curable ink on the media. The application of the UVC radiation to the UV curable ink may provide curing to the exposed surface of the UV curable ink. The subsequent application of UVA radiation may provide deep ink curing that cures the UV curable ink beyond its exposed surface while reducing the penetration of oxygen from the surrounding area outside of the UV curable ink into the UV curable ink due to the previously cured expose surface. Consequently, the reduction in the amount of oxygen penetrating into the UV curable ink from the surrounding area outside of the UV curable ink may enable lower levels of radiation to sufficiently cure the UV curable ink.

Figure 1:
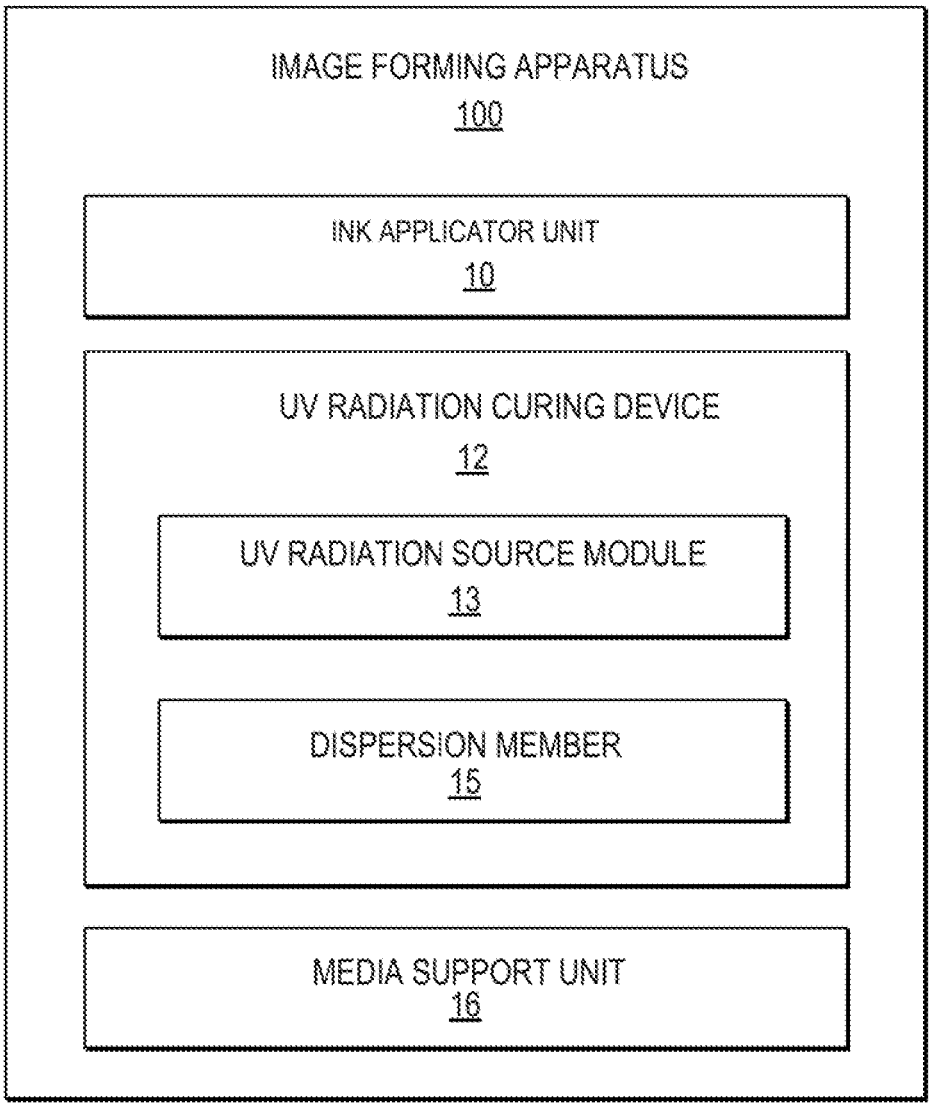
FIG. 1 is a block diagram illustrating an image forming apparatus according to an example.
Figure 2:
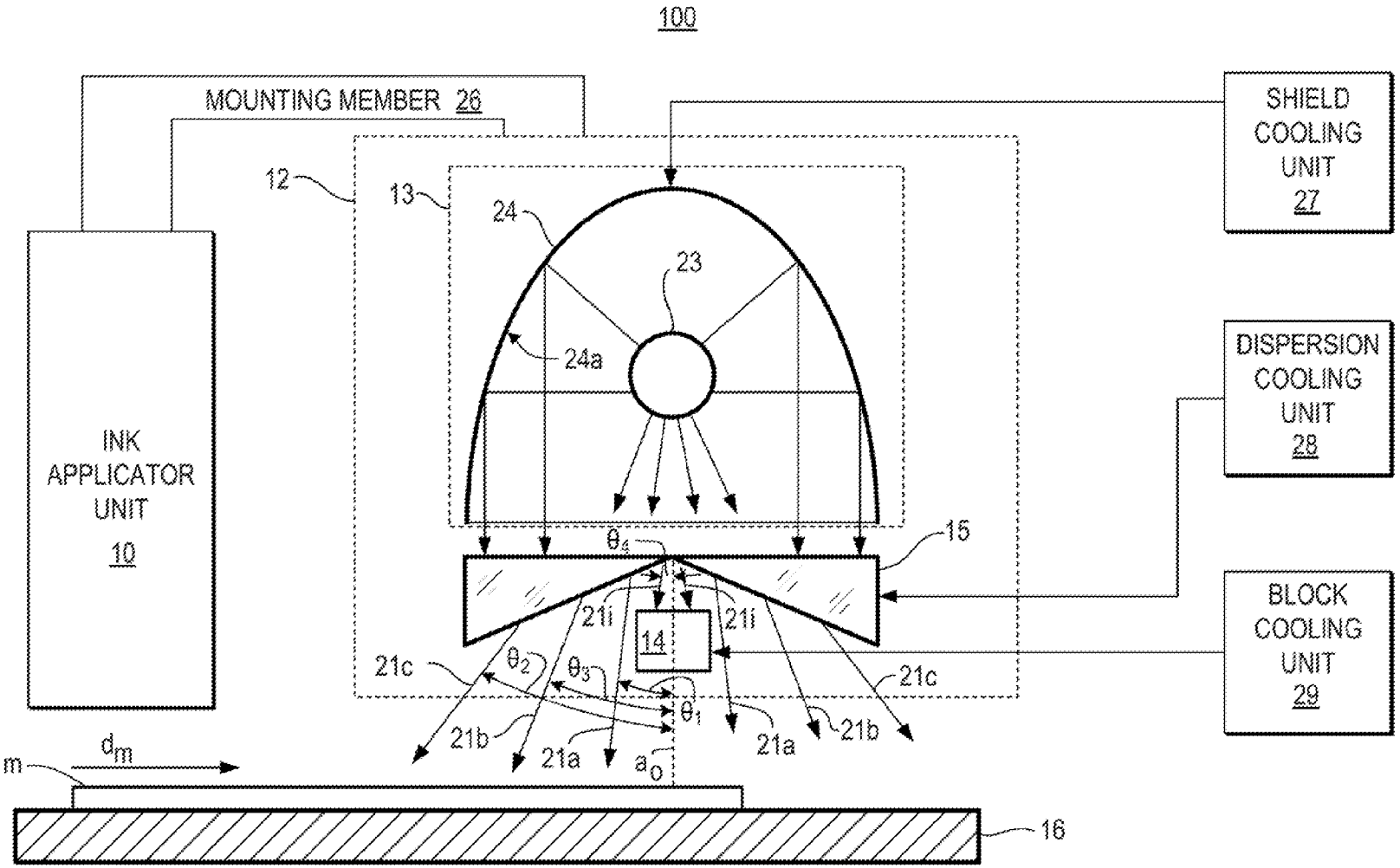
FIG. 2 is a schematic view illustrating the image forming apparatus of FIG. 1 according to an example.
Figure 3:
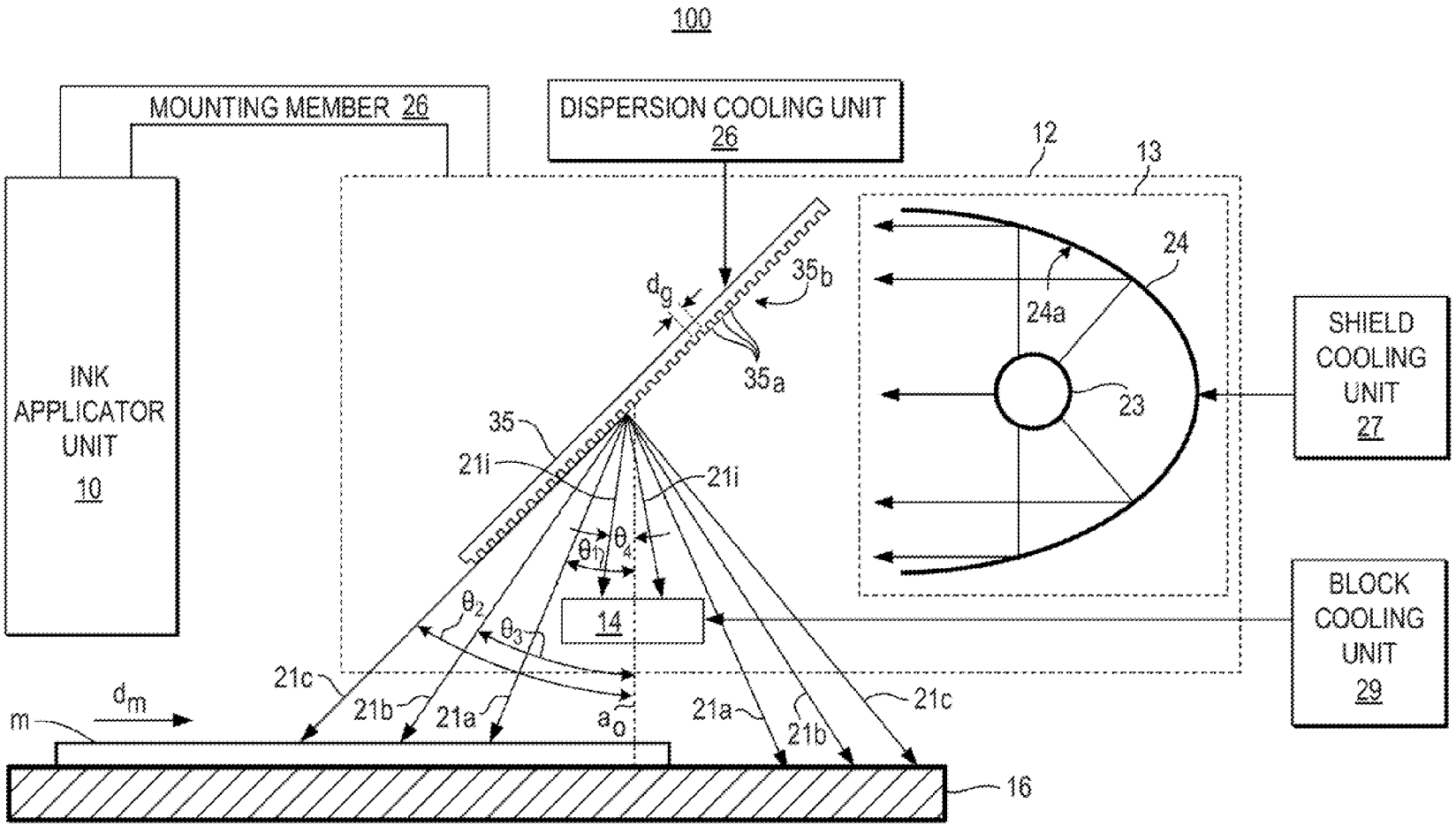
FIG. 3 is a schematic view illustrating the image forming apparatus of FIG. 1 including a diffraction grating member according to an example.

FIG. 1 is a block diagram illustrating an image forming apparatus according to an example. Referring to FIG. 1, in some examples, an image forming apparatus 100 includes an ink applicator unit 10, a media support unit 16, and a UV radiation curing device 12. The ink applicator unit 10 may selectively apply ultraviolet (UV) curable ink on a media m (FIGS. 2 and 3). In some examples, the image forming apparatus 100 may include a plurality of ink applicator units 10. The ink applicator unit 10 may be an inkjet printhead, and the like. The media support unit 16 may support the media m to receive the UV curable ink. For example, the media support unit 16 may be a bed, platen,drum and the like. The UV radiation curing device 12 may cure the UV curable ink on the media m. The UV radiation curing device 12 may include a UV radiation source module 13 and a dispersion member 15. The UV radiation source module 13 may emit an electromagnetic spectrum. In some examples, the UV radiation source module 13 may include a mercury vapor lamp.

The dispersion member 15 may separate ultraviolet electromagnetic radiation subtype C (UVC radiation) 21*c* from at least one of ultraviolet electromagnetic radiation subtype A (UVA radiation) 21*a* and ultraviolet electromagnetic radiation subtype B (UVB radiation) in the electromagnetic spectrum. The dispersion member 15 may also apply the UVC radiation to the UV curable ink on the media m. The dispersion member 15 may subsequently apply the at least one of the UVA radiation and the UVB radiation after the UVC radiation is applied to the UV curable ink on the media m. In some examples, the UVA radiation may be applied to the UV curable ink on the media after the UVC radiation is applied thereto. Alternatively, the UVB radiation may be applied to the UV curable ink on the media after the UVC radiation is applied thereto. Still yet, both the UVB radiation and the UVA radiation may be applied to the UV curable ink on the media after the UVC radiation is applied thereto such that the UVA radiation is applied to the UV curable ink on the media after the UVB radiation is applied thereto.

The application of the UVC radiation to the UV curable ink may provide curing of the exposed surface of the UV curable ink. Such exposed surface curing may result in as a barrier to prevent oxygen from the atmosphere surrounding the ink surface from penetrating into the ink when the at least one of UVA radiation and UVB radiation is subsequently applied thereto. That is, when the at least one of the UVA radiation and the UVB radiation is applied to the UV curable ink, the exposed surface of the UV curable ink will have already been cured by the UVC radiation. Thus, the subsequent application of UVA radiation may provide deep ink curing that cures the ink beyond its exposed surface while reducing the penetration of oxygen from the surrounding area outside of the UV curable ink into the UV curable ink. Reducing the amount of oxygen penetrating from the atmosphere into the UV curable ink may enable lower levels of radiation to sufficiently cure the UV curable ink. In some examples, the dispersion member 15 may include a prism, a diffraction grating member, and the like.

FIG. 2 is a schematic view illustrating the image forming apparatus of FIG. 1 according to an example. FIG. 3 is a schematic view illustrating the image forming apparatus of FIG. 1 including a diffraction grating member according to an example. Referring to FIGS. 2 and 3, in some examples, the image forming apparatus 100 may include an ink applicator unit 10, a UV radiation curing device 12, and a media support unit 16. The UV radiation curing device 12 may include a UV radiation source module 13, a dispersion member 15 such as a diffractive grating member 35, and a blocking member 14. The UV radiation source module 13 may include a source member 23 and a shielding member 24. The source member 23 may emit the electromagnetic spectrum. For example, the electromagnetic spectrum may include various wavelengths in the UV and infrared spectrum. In some examples, the UV radiation source module 13 may include a mercury vapor lamp, and the like. The shielding member 24 may surround at least a portion of the source member 23. The shielding member 23 may include a surface 24*a* to reflect at least a portion of the electromagnetic spectrum to the dispersion member 15. Another portion of the electromagnetic spectrum may include infrared (IR) radiation.

In some examples, the surface 24*a* of the shielding member 24 may be configured to at least one of absorb and transmit there through another portion of the electromagnetic spectrum. The shielding member 24, for example, may include a reflector. In some examples, the reflector may be transparent and include a coating to transmit IR radiation and reflect UV radiation. Alternatively, the reflector may be non-transparent such a metal reflector and include a coating to enhance absorption of IR radiation. In some examples, the reflector may be a parabolic reflector to collect the radiation emitted by the source member 23 and form a collimated beam. Alternatively, water can also be used to transmit UV radiation and reflect the IR radiation.

Referring to FIGS. 2 and 3, in some examples, the at least a portion of the electromagnetic spectrum may include the UVA radiation 21*a*, the UVC radiation 21*c*, and IR radiation 21*i*. Additionally, the at least a portion of the electromagnetic spectrum may also include ultraviolet electromagnetic radiation subtype B (UVB radiation) 21*b*. The dispersion member 15 may be configured to also separate UVB radiation 21*b* from the UVC radiation 21*c* and the UVA radiation 21*a* in the electromagnetic spectrum. The dispersion member 15 may also be configured to separate and apply the UVC radiation 21*c* to the UV curable ink on the media m, subsequently apply the UVB radiation 21*b* to the UV curable ink on the media m after application of the UVC radiation 21*c* to the UV curable ink on the media m, and subsequently apply the UVA radiation 21*a* to the UV curable ink on the media m after the application of the UVA radiation 21*a* to the UV curable ink on the media m. Additionally, in some examples, the dispersion member 15 may also be configured to separate the IR radiation 21*i* from the UVA radiation 21*a*, the UVB radiation 21*b*, and UVC radiation 21*c*.

In some examples, the UVA radiation 21*a* separated from the UVC radiation 21*c* by the dispersing member 15 may form a first acute angle $\theta_1$ with an optical axis $a_o$ of the dispersing member 15. The UVC radiation 21*c* separated from the UVA radiation 21*a* by the dispersing member 15 may form a second acute angle $\theta_2$ with the optical axis $a_o$ of the dispersing member 15 that is greater than the first acute angle $\theta_1$. The UVB radiation 21*b* separated from the UVA radiation 21*a* and the UVC radiation 21*c* by the dispersing member 15 may form a third acute angle $\theta_3$ with the optical axis $a_o$ of the dispersing member 15 that is less than the second angle $\theta_2$ and is greater than the first acute angle $\theta_1$. The IR radiation 21*i* separated from the UVA radiation 21*a*, UVB radiation 21*b*, and UVC radiation 21*c* by the dispersing member 15 may form a fourth acute angle $\theta_4$ with an optical axis $a_o$ of the dispersing member 15. In some examples, the fourth acute angle $\theta_4$ with the optical axis $a_o$ of the dispersing member 15 may be less than the first acute angle $\theta_1$.

Referring to FIGS. 2 and 3, the blocking member 14 may block the IR radiation 21*i* emitted by the source module 23 from reaching the media m. In some examples, the image forming apparatus 100 may also include a mounting member 26, a shield cooling unit 27, a block cooling unit 29, and a dispersion cooling unit 28. The mounting member 26 may mount the ink applicator unit 10 and the UV radiation curing device 12 thereon. The UV radiation curing device 12 may apply radiation to the media m to cure the UV curable ink at the same speed and/or during a single pass of the UV curable ink under the UV lamp. In some examples, the mounting member 26 may include a plurality of UV radiation curing devices 12 and a plurality of ink applicator units 10 disposed between the UV radiation curing devices 12. In some examples, the mounting member 26 and the media m supported by the media support unit 16 may be configured to selectively move with respect to each other. That is, the mounting member 26 may be static and the media m may move with respect to the mounting member 26 in a media advancement direction $d_m$, the mounting member 26 may move with respect to the media m and the media m may be static, or the mounting member 26 and the media m may both move with respect to each other.

Referring to FIGS. 2 and 3, in some examples, the shield cooling unit 27 may be in communication with and cool a temperature of the shielding member 24. That is, the shield cooling unit 27 may apply fluid and/or air to reduce the temperature of the shielding member 24 that may have increased due to absorption of energy received from the source module 23. The block cooling unit 29 may be in communication with and cool a temperature of the blocking member 14. That is, the block cooling unit 29 may apply fluid and/or air to reduce the temperature of the blocking member 14 that may have increased due to absorption of energy received from the blocking of IR radiation 21*i*. The dispersion cooling unit 28 may be in communication with and cool a temperature of the dispersion member 15. That is, the dispersion cooling unit 28 may apply fluid and/or air to reduce the temperature of the dispersion member 15 that may have increased due to absorption of energy received from at least one of the UVA radiation 21*a*, the UVB radiation 21*b*, the UVC radiation, and IR radiation 21*i* that it dispersed.

Referring to FIG. 3, in some examples, the dispersion member may be in a form of a diffraction grating member 35. The diffraction grating member 35 may include a plurality of grooves 35*a* spaced apart from each other by a predetermined distance $d_g$. The grooves 35*a* spaced apart from each other allow separation between the respective spectral components that come in contact therewith. The diffraction grating member 35 may disperse the UVC radiation 21*c*, the UVA radiation 21*a*, the UVB radiation 21*b*, and IR radiation 21*i* of the electromagnetic spectrum. In some examples, the diffraction grating member 35 may be a reflective diffraction grating member including a radiation receiving surface 35*b*. In some examples, the radiation receiving surface 35*b* may include a coating to enhance IR absorption and/or transmission. For example, the reflective diffraction grating member may include metal such as aluminum and/or copper.

Alternatively, the diffraction grating member 35 may be a transmission diffraction grating member including a radiation accepting surface. The radiation accepting surface may include a coating to enhance IR reflection. In some examples, a blocking member 14 may block the IR radiation 21*i* dispersed by the diffraction grating member 35 from reaching the media m. Thus, a media m may move with respect to ink applicator unit 10 and the diffractive grating member 35 in a media advancement direction $d_m$ to receive the UVC radiation 21*c* before the UVA radiation 21*a*. In some examples, the media may also receive UVB radiation 21*b* after the UVC radiation 21*c* and prior to the UVA radiation 21*a*.

Figure 4:
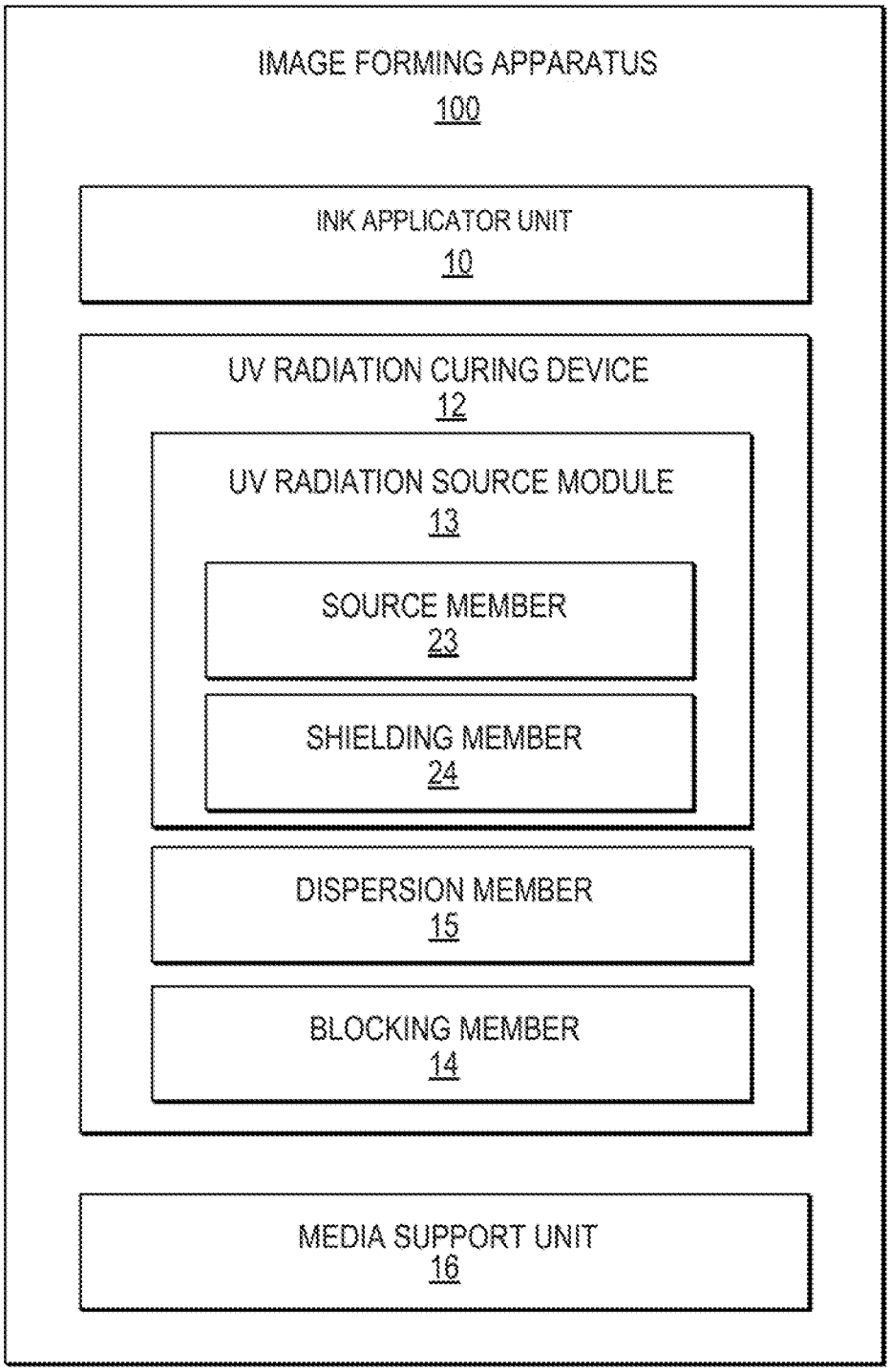
FIG. 4 is a block diagram illustrating an image forming apparatus according to an example.

FIG. 4 is a block diagram illustrating an image forming apparatus according to an example. Referring to FIG. 4, in some examples, an image forming apparatus 100 may include an ink applicator unit 10, a UV radiation curing device 12, and a media support member 16. The ink applicator unit 10 may selectively apply UV curable ink on a media. The UV radiation curing device 12 may cure the UV curable ink on the media. The UV radiation curing device 12 may include a UV radiation source module 13, a dispersion member 15, and a blocking member 14. The UV radiation source module 13 may include a source member 23 and a shielding member 24. The source member 23 may emit an electromagnetic spectrum. The shielding member 24 may surround at least a portion of the source member 23. The shielding member 24 may include a surface 24*a* (FIG. 2) to reflect the electromagnetic spectrum.

Referring to FIGS. 2 and 4, in some examples, the dispersion member 15 may receive the electromagnetic spectrum from the shielding member 24 to separate UVC radiation, UVA radiation, and IR radiation in the electromagnetic spectrum from each other. For example, the dispersion member 15 may form a first acute angle $\theta_1$ between the UVA radiation 21*a* and an optical axis $a_o$ of the dispersing member 15, a second acute angle $\theta_2$greater than the first acute angle $\theta_1$ between the UVC radiation 21 c and the optical axis $a_o$, and a fourth acute angle $\theta_4$ less than the first acute angle $\theta_1$ between the IR radiation 21*i* and the optical axis $a_o$. In some examples, the dispersion member 15 may also separate UVB radiation 21*b* in the electromagnetic spectrum from the other spectral components. For example, the dispersion member 15 may form a third acute angle $\theta_3$ between the UVB radiation 21*b* and the optical axis $a_o$ that is less than the second acute angle $\theta_2$ and greater than the first acute angle $\theta_1$.

Figure 5:
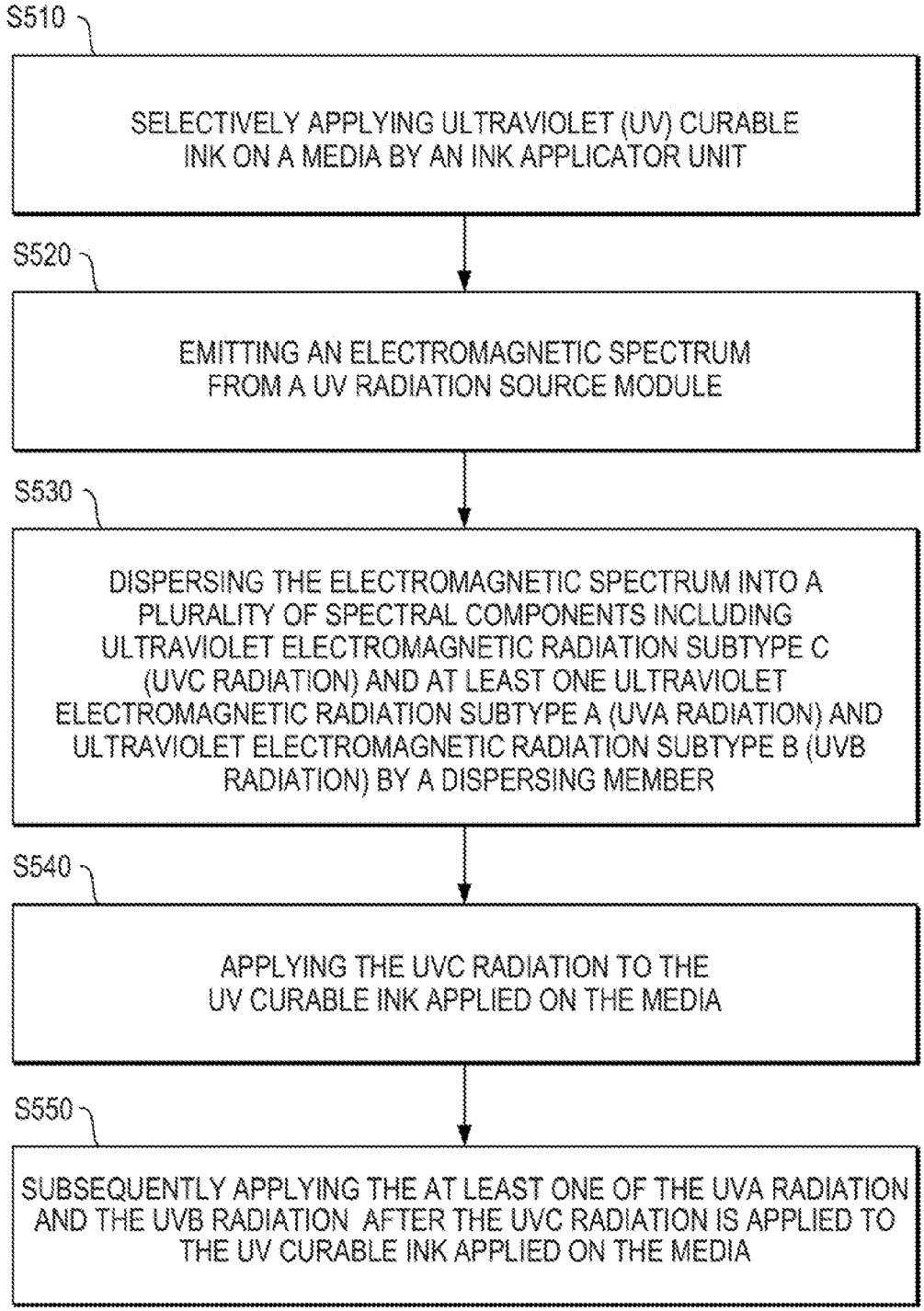
FIG. 5 is a flowchart illustrating a method of printing on media according to an example.

FIG. 5 is a flowchart illustrating a method of printing on media according to an example. Referring to FIG. 5, in block S510, ultraviolet (UV) curable ink is selectively applied on a media by an ink applicator unit. In block S520, an electromagnetic spectrum is emitted from a UV radiation source module. For example, the electromagnetic spectrum is emitted by a source member. Additionally, at least a portion of the electromagnetic spectrum is reflected by a shielding member surrounding at least a portion of the source member to the dispersion member. In block S530, the electromagnetic spectrum is dispersed into a plurality of spectral components including UVC radiation and at least one of UVA radiation and UVB radiation by a dispersing member.

For example, the dispersing member may form a first acute angle between the UVA radiation and an optical axis of the dispersing member. The dispersing member may also form a second acute angle greater than the first acute angle between the UVC radiation and the optical axis of the dispersing member. In some examples, the electromagnetic spectrum being dispersed into a plurality of spectral components including UVC radiation and at least one of UVA radiation and UVB radiation by a dispersing member may also include forming a fourth acute angle between IR radiation and the optical axis of the dispersing member by the dispersing member and blocking the IR radiation from reaching the media by a blocking member. It may also include forming a third acute angle between the UVB radiation and the optical axis of the dispersing member by the dispersing member that is less than the second acute angle and is greater than the first acute angle. In some examples, the fourth acute angle may be less than the first acute angle.

In block S540, the UVC radiation is applied to the UV curable ink applied on the media. In block S550, at least one of the UVA radiation and the UVB radiation is subsequently applied to the UV curable ink on the media after the UVC radiation. In some examples, the method may also include subsequently applying UVB radiation after the UVC radiation to the UV curable ink applied on the media and prior to the UVA radiation. For example, the method may also include forming a third acute angle between the UVB radiation and the optical axis of the dispersing member by the dispersing member that is less than the second acute angle and is greater than the first acute angle. In some examples, the method may also include at least one of absorbing and transmitting there through by the shielding member an other portion of the electromagnetic spectrum corresponding to IR radiation.

The method may also include selectively moving the media supported by a media support unit and a mounting member having the ink applicator unit, the UV radiation source module, and the dispersing member mounted thereon with respect to each other. In some examples, the selectively applying UV curable ink on the media by the ink applicator unit, the applying the UVC radiation to the UV curable ink applied on the media, and the subsequently applying the UVA radiation after the UVC radiation is applied to the UV curable ink applied on the media are performed in a single pass of curing UV curable ink by the UV radiation source module.

It is to be understood that the flowchart of FIG. 5 illustrates architecture, functionality, and/or operation of an example of the present disclosure. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowchart of FIG. 5 illustrates a specific order of execution, the order of execution may differ from that which is depicted. For example, the order of execution of two or more blocks may be scrambled relative to the order illustrated. Also, two or more blocks illustrated in succession in FIG. 5 may be executed concurrently or with partial concurrence. All such variations are within the scope of the present disclosure.

The present disclosure has been described using non-limiting detailed descriptions of examples thereof and is not intended to limit the scope of the present disclosure. It should be understood that features and/or operations described with respect to one example may be used with other examples and that not all examples of the present disclosure have all of the features and/or operations illustrated in a particular figure or described with respect to one of the examples. Variations of examples described will occur to persons of the art. Furthermore, the terms "comprise," "include," "have" and their conjugates, shall mean, when used in the present disclosure and/or claims, "including but not necessarily limited to."

It is noted that some of the above described examples may include structure, acts or details of structures and acts that may not be essential to the present disclosure and are intended to be exemplary. Structure and acts described herein are replaceable by equivalents, which perform the same function, even if the structure or acts are different, as known in the art. Therefore, the scope of the present disclosure is limited only by the elements and limitations as used in the claims.

What is claimed is:

1. An image forming apparatus, comprising:

an ink applicator unit to selectively apply ultraviolet (UV) curable ink on a media;

a media support unit to support the media to receive the UV curable ink; and a UV radiation curing device to cure the UV curable ink on the media, including:

a UV radiation source module to emit an electromagnetic spectrum; and a dispersion member to separate ultraviolet electromagnetic radiation subtype C (UVC radiation) from at least one of ultraviolet electromagnetic radiation subtype A (UVA radiation) in the electromagnetic spectrum and ultraviolet electromagnetic radiation subtype B (UVB radiation) in the electromagnetic spectrum, to apply the UVC radiation to the UV curable ink on the media, and to subsequently apply at least one of the UVA radiation and UVB radiation after the UVC radiation is applied to the UV curable ink on the media.

2. The image forming apparatus according to claim 1, wherein the UV radiation source module further comprises:

a source member to emit the electromagnetic spectrum; and a shielding member to surround at least a portion of the source member, the shielding member having a surface to reflect at least a portion of the electromagnetic spectrum to the dispersion member.

3. The image forming apparatus according to claim 2, wherein the surface of the shielding member is configured to at least one of absorb and transmit there through an other portion of the electromagnetic spectrum.

4. The image forming apparatus according to claim 3, wherein the other portion of the electromagnetic spectrum comprises infrared radiation.

5. The image forming apparatus according to claim 2, wherein the at least a portion of the electromagnetic spectrum comprises the UVA radiation, the UVB radiation, the UVC radiation, and infrared (IR) radiation.

6. The image forming apparatus according to claim 5, further comprising:

a blocking member to block the IR radiation emitted by the source module from reaching the media.

7. The image forming apparatus according to claim 1, further comprising:

a mounting member to mount the ink applicator unit and the UV radiation curing device thereon; and wherein the mounting member and the media supported by the media support unit are configured to selectively move with respect to each other.

8. The image forming apparatus according to claim 1, wherein the UVA radiation separated from the UVC radiation by the dispersing member forms a first acute angle with an optical axis of the dispersing member and the UVC radiation separated from the UVA radiation by the dispersing member forms a second acute angle with the optical axis of the dispersing member that is greater than the first acute angle.

9. The image forming apparatus according to claim 8, wherein the dispersion member is configured to separate ultraviolet electromagnetic radiation subtype B (UVB radiation) from the UVC radiation and the UVA radiation in the electromagnetic spectrum, and subsequently apply the UVB radiation to the UV curable ink on the media after the UVC radiation and prior to applying the UVA radiation to the UV curable ink on the media such that the dispersion member is configured to form a third acute angle with the optical axis of the dispersing member that is less than the second acute angle and greater than the first acute angle.

10. The image forming apparatus according to claim 1, wherein the dispersion member further comprises:

a diffraction grating member having a plurality of grooves spaced apart from each other by a predetermined distance, the diffraction grating member to disperse the UVC radiation, the UVA radiation, and infrared (IR) radiation of the electromagnetic spectrum.

11. The image forming apparatus according to claim 10, further comprising:

a blocking member to block the IR radiation dispersed by the diffraction grating member from reaching the media.

12. An image forming apparatus, comprising:

an ink applicator unit to selectively apply ultraviolet (UV) curable ink on a media; and a UV radiation curing device to cure the UV curable ink on the media, the UV radiation curing device including:

a UV radiation source module including:

a source member to emit an electromagnetic spectrum;

a shielding member to surround at least a portion of the source member, the shielding member having a surface to reflect the electromagnetic spectrum; and a dispersion member to receive the electromagnetic spectrum from the shielding member and to separate ultraviolet electromagnetic radiation subtype C (UVC radiation), ultraviolet electromagnetic radiation subtype A (UVA radiation), ultraviolet electromagnetic radiation subtype B (UVB radiation),and infrared (IR) radiation in the electromagnetic spectrum from each other by forming a first acute angle between the UVA radiation and an optical axis of the dispersing member, a second acute angle greater than the first acute angle between the UVC radiation and the optical axis, a third acute angle between the UVB radiation and the optical axis of the dispersing member, and a fourth acute angle less than the first acute angle between the IR radiation and the optical axis; and a blocking member to block the IR radiation separated by the dispersion member from reaching the media.

13. A method of printing on media, comprising:

selectively applying ultraviolet (UV) curable ink on a media by an ink applicator unit;

emitting an electromagnetic spectrum from a UV radiation source module;

dispersing the electromagnetic spectrum into a plurality of spectral components including ultraviolet electromagnetic radiation subtype C (UVC radiation) and at least one of ultraviolet electromagnetic radiation subtype A (UVA radiation) and ultraviolet electromagnetic radiation subtype B (UVB radiation) by a dispersing member;

applying the UVC radiation to the UV curable ink applied on the media; and subsequently applying the at least one of the UVA radiation and the UVB radiation after the UVC radiation is applied to the UV curable ink applied on the media.

14. The method according to claim 13, wherein the dispersing the electromagnetic spectrum into a plurality of spectral components including UVC radiation and UVA radiation by a dispersing member further comprises:

forming a first acute angle between the UVA radiation and an optical axis of the dispersing member by the dispersing member; and forming a second acute angle greater than the first acute angle between the UVC radiation and the optical axis of the dispersing member by the dispersing member.

15. The method according to claim 14, wherein the selectively applying UV curable ink on the media by the ink applicator unit, the applying the UVC radiation to the UV curable ink applied on the media, and the subsequently applying the UVA radiation after the UVC radiation to the UV curable ink applied on the media are performed in a single pass of the media by the mounting member.

16. The method according to claim 14, further comprising:

subsequently applying ultraviolet electromagnetic radiation subtype B (UVB radiation) after the UVC radiation to the UV curable ink applied on the media and prior to the UVA radiation by forming a third acute angle between the UVB radiation and the optical axis of the dispersing member by the dispersing member that is less than the second acute angle and greater than the first acute angle.

17. The method according to claim 14, wherein the dispersing the electromagnetic spectrum into a plurality of spectral components including UVC radiation and UVA radiation by a dispersing member further comprises:

forming a fourth acute angle between infrared radiation (IR) and the optical axis of the dispersing member by the dispersing member; and blocking the IR radiation from reaching the media by a blocking member.

18. The method according to claim 13, wherein the emitting an electromagnetic spectrum from a UV radiation source further comprises:

emitting the electromagnetic spectrum by a source member, and reflecting at least a portion of the electromagnetic spectrum by a shielding member surrounding at least a portion of the source member to the dispersion member.

19. The method according to claim 18, further comprising:

at least one of absorbing and transmitting there through by the shielding member an other portion of the electromagnetic spectrum corresponding to infrared (IR) radiation.

20. The method according to claim 13, further comprising:

selectively moving the media supported by a media support unit and a mounting member having the ink applicator unit, the UV radiation source module, and the dispersing member mounted thereon with respect to each other.

* * * * *

UNITED STATES PATENT AND TRADEMARK OFFICE

CERTIFICATE OF CORRECTION

PATENT NO. : 8,573,767 B2
APPLICATION NO. : 13/358793
DATED : November 5, 2013
INVENTOR(S) : Yochai Edlitz et al.

It is certified that error appears in the above-identified patent and that said Letters Patent is hereby corrected as shown below:

In the Claims

In column 8, line 33, in Claim 12, delete ",and" and insert -- , and --, therefor.

In column 10, lines 9-10, in Claim 18, delete "member," and insert -- member; --, therefor.

Signed and Sealed this
Third Day of June, 2014

Michelle K. Lee

Michelle K. Lee
*Deputy Director of the United States Patent and Trademark Office*